United States Patent [19]

Yamamoto et al.

[11] Patent Number: 4,517,030

[45] Date of Patent: May 14, 1985

[54] PROCESS FOR ACTIVATING STEEL SURFACE PRIOR TO PHOSPHATING TREATMENT AQUEOUS ACTIVATING SOLUTION THEREFOR

[75] Inventors: Tsukasa Yamamoto; Asao Mochizuki, both of Toyota; Hiroshi Okita, Nihonbashi; Toshi Miyawaki, Nihonbashi; Yoshiji Shirogane, Nihonbashi; Kazuhiko Mori, Nihonbashi, all of Japan

[73] Assignees: Toyota Motor Corp.; Nihon Parkerizing Co., both of Japan

[21] Appl. No.: 637,755

[22] Filed: Aug. 6, 1984

[51] Int. Cl.[3] ..... C23F 7/10

[52] U.S. Cl. ..... 148/6.15 R; 148/6.15 Z

[58] Field of Search ..... 148/6.15 Z, 6.15 R

[56] References Cited

U.S. PATENT DOCUMENTS 3,741,747 6/1973 Hamilton ..... 148/6.15 Z
3,864,139 2/1975 Heller ..... 148/6.15 Z
4,152,176 5/1979 Guhder ..... 148/6.15 Z

FOREIGN PATENT DOCUMENTS 56675 7/1982 Japan ..... 148/6.15 R
84979 5/1983 Japan ..... 148/6.15 R

*Primary Examiner*—Sam Silverberg
*Attorney, Agent, or Firm*—Ostrolenk, Faber, Gerb & Soffen

[57] ABSTRACT

This invention discloses a process for activating steel surface prior to phosphating treatment wherein the steel surface is cleaned, the cleaned steel surface is then treated with an aqueous activating solution containing titanium and pyrophosphate ion, and thereafter the steel surface is treated with a phosphating solution, characterized in that magnesium ion is included in said aqueous activating solution in order to suppress formation of an inactive film on said steel surface due to the presence of said pyrophosphate ion, and then said steel surface is treated with the resulting aqueous activating solution.

11 Claims, No Drawings

PROCESS FOR ACTIVATING STEEL SURFACE PRIOR TO PHOSPHATING TREATMENT AQUEOUS ACTIVATING SOLUTION THEREFOR

BACKGROUND OF THE INVENTION (1) Field of the Invention

This invention relates to an improved process for activating of steel and to an aqueous activating solution utilized for acceleration of the formation of phosphate coating as well as for refinement of phosphate coating crystals prior to phosphating, particularly zinc phosphating treatment which is applied to steel surfaces prior to the painting, particularly electropainting.

Such activating treatment by the use of an aqueous activating solution containing titanium ion and colloidal titanium (hereinafter reffered generically to as "titanium") has been effected for accelerating the formation of the phosphate coating on steel surfaces by means of activation of the surface thereof as well as for refining phosphate coating crystals in the phosphating treatment process for the surfaces of the steel and surface treated steels represented by zinc plated steels and the like are to be fabricated. An example of the process as mentioned above includes the following steps:

alkaline cleaning→multi-stage water rinsing→activating treatment→phosphating treatment→multistage water rinsing→deionizing water rinsing→drying-off→painting (cathodic electro painting, anodic electro painting, dip painting, spray painting and the like).

(2) Description of the Prior Art

Activating compositions utilized for activating steel surfaces have been publicly known in, for example, U.S. Pat. Nos. 2,874,081, 2,322,349, 2,310,239 and so on and which disclose titanium pyrophosphate ion, orthophosphate ion, sodium ion and the like contained in activating compositions as their main components. There were, however, the following disadvantages in the case when an aqueous activating solution prepared from conventional activating compositions is applied prior to phosphating treatment.

The first disadvantage is that while a comparatively dense and fine-size crystalline phosphate coating can be formed in a phosphating treatment by application of an aqueous activating solution immediately after fresh buildup, but a coarse crystalline phosphate coating or phosphate coating is obtained on the steel surface by the application of the aqueous activating solution of 2 or more day lapse after buildup (the lapse of 2 or more days involves either a case where such time elapses after the buildup with the use of the solution for activating treatment, or a case where the solution is allowed to stand for 2 more days without employing after the buildup). In other words, the effect of formation of the fine-size crystalline phosphate coating as mentioned above is easily reduced, so that there was a disadvantage in that such aqueous activating solution exhibits deterioration with time. For the sake of reviving to a aqueous activating solution in such performance being substantially the same as that of the initial solution immediately after buildup, even if an activating composition is replenished in the aqueous activating solution, such effect as described above cannot be attained. For this reason, such aqueous activating solution must frequently be discarded. This is obviously disadvantageous in view of control of the aqueous solution and economy.

The second disadvantage is that while the above-mentioned deterioration with time can be suppressed by increasing the concentration of pyrophosphate ion in such aqueous activating solution to 60 ppm or more, on the other hand, pyrophosphate ion reacts with the steel surface to form an inactive film, i.e., so-called inactivation of steel surface is observed. Thus, when the steel surface with the inactive film is subjected to phosphating treatment, an non-uniform coating of blue color, white spot and the like is easily formed so that an uniform phosphate coating is hardly formed. When such non-uniform coating is electro coated in, for example, the following stage, a surface roughening of the electro coated film is induced and it results in disadvantages such as deterioration of corrosion resistance, particularly filiform corrosion resistance of the paint film. The reaction of pyrophosphate ion with steel surface as mentioned above depends on the type of steel. For instance, since drawing quality bake-hardenable high tension steel has higher surface activity than that of JIS-G-3141 SPCC, the former reacts easily so that the former steel has a tendency to easily form such a non-uniform coating as described above on the surface thereof.

The disadvantages as mentioned above cannot be overcome by adding an alkaline phosphate such as disodium phosphate, trisodium phosphate or the like to the aqueous activating solution, or by increasing the titanium concentration in the aqueous solution. Thus the aqueous activating solution prepared from conventional activating compositions involves said disadvantages which are difficult to overcome technically.

SUMMARY OF THE INVENTION

For the sake of solving the above described problems, the present inventors have studied the aqueous activating solution. As a result, the inventors found the following fact so that the present invention has been completed. This is, when a specified amount of magnesium (Mg) ion is in the aqueous solution with an amount of pyrophosphate ($P_2O_7$) ion and when each concentration of the essential ingredients including these ions and pH of the solution are controlled as specified below, deterioration of the aqueous activating solution with time can be suppressed and in addition, an uniform dense and fine-size crystalline phosphate coating can be stably formed on the steel surface in the subsequent phosphating treatment without causing the problem of inactivation of the steel surface due to pyrophosphate ion, even through the concentration of pyrophosphate ion is 60 ppm or more in the aqueous activating solution.

DETAILED DESCRIPTION OF THE INVENTION

Essential ingredients and pH for the aqueous activating solution according to the present invention are as follows:

(1) Titanium (Ti): 3–100 ppm
(2) Pyrophosphate $P_2O_7$ ion: 60–360 ppm
(3) The total phosphate ion as $PO_4$: 150–3,000 ppm
(4) Magnesium (Mg) ion specified by the following molar ratio—Mg mol/$P_3O_7$ mol: 0.4–1.1
(5) pH: 8.0–9.5

More specifically, the present invention relates to a process for activating steel surface wherein the steel surface is cleaned, the cleaned steel surface is then treated with an aqueous activating solution containing titanium and pyrophosphate ion, and the steel surface thus treated is then treated with a phosphating solution, characterized by treating said steel surface with the aqueous activating solution into which magnesium ion is included in order to suppress formation of an inactive film on said steel surface due to the presence of said pyrophosphate ion.

The invention relates also to an aqueous activating solution which is applied prior to phosphating treatment, characterized in that said aqueous activating solution comprises 3–100 ppm of titanium, 60–360 ppm of pyrophosphate ($P_2O_7$) ion, and 0.4–1.1 molar ratio of magnesium ion to said pyrophosphate ion, and a pH of said solution ranges 8.0–9.5.

Each constitutional ion in the present invention can be prepared from one, two or more of the following compounds:

Titanium (Ti): titanyl sulfate, titanium tetrachloride, titanium trichloride, titanium hydroxide, titanium oxide and the like.

Pyrophosphate: ($P_2O_7$) ion sodium pyrophosphate, magnesium ammonium pyrophosphate and the like.

The total phosphate ion, as $PO_4$: In addition to the above pyrophosphates, disodium phosphate, diammonium phosphate, trisodium phosphate, triammonium phosphate.

Magnesium (Mg) ion: magnesium ammonium pyrophosphate, magnesium sulfate, basic magnesium carbonate and the like.

An outline for preparing an activating composition which can be utilized for the aqueous activating solution according to the present invention will be described hereinbelow in connection with one example thereof.

To 90–160 parts (by weight, the same shall apply hereinafter) of about 50% (by weight, the same shall apply hereinafter) aqueous solution of disodium phosphate 15 parts or less of sodium pyrophosphate anhydrous are added and dissolved. Then 5–7 parts of titanyl sulfate (19% as titanium) are added to the solution, and then the solution is sufficiently agitated while heating at a temperature of 70°–80° C., thereby to obtain a white powder having a moisture content of 5% or less. Thereafter, the powder is further agitated at a termperature of 80°–100° C. and to which sodium pyrophosphate anhydrous, to the extent of the amount to make 15–40 parts in total, and 5–15 parts of magnesium sulfate anhydrous are added. Then, the mixture is dried while agitating until the moisture content thereof becomes 2% or less. The resulting white powder having a moisture content of 2% or less may be utilized as an activating composition for preparing the aqueous activating solution according to the present invention.

An aqueous dispersion containing about 0.3—about 5 g of the above powder per liter (in which colloidal titanium is dispersed) can be utilized for the aqueous activating solution according to the present invention. On the other hand, the aqueous activating solution may be prepared by such manner that the aqueous solution has previously been prepared by using an activating composition containing no magnesium compound, and thereafter a magnesium compound is added to the resulting aqueous solution. However, in view of activating effects, it is preferable to use an activating composition containing magnesium.

The concentration of each ion contained in the aqueous activating solution of the present invention as well as effects and advantages thereof will be described hereinbelow.

First, it is preferable that titanium (Ti) in the aqueous activating solution has a concentration of 3–100 ppm. When less that 3 ppm, the formation of the fine-size crystalline phosphate coating on the steel surface is insufficient in the subsequent phosphating treatment. On the other hand, when more than 100 ppm, the same phosphate crystal refining effect as in the case of 3–100 ppm is achieved, but the upper limit of 100 ppm is preferable from economical point of view.

A concentration of pyrophosphate ($P_2O_7$) ion in the aqueous activating solution is preferably 60–360 ppm. When the concentration is less than 60 ppm, deterioration of the resulting aqueous activating solution with time becomes remarkable, and such a low concentration of pyrophosphate ion results in insufficient effect of refinement of crystals and of reduction of coating weight of phosphate coating formed in the following phosphating stage. When maintained at 60–360 ppm concentration, the above-mentioned deterioration with time can be suppressed, and pyrophosphate ion provides phosphate crystal refining effect while the effect of pyrophosphate ion is inferior to that of titanium. In addition, the pyrophosphate ion has a remarkable effect for reducing phosphate coating weight so that a thin, fine-size crystalline phosphate coating of high quality for a paint base can be formed as a result of synergistic effect with titanium.

A further advantage of pyrophosphate ion is in suppression of the influence of water quality utilized for preparing an aqueous activating solution. For example, when water containing calcium ion, chlorine ion or the like is employed, such water lessens activating effect because the above described ions have the effect for aggregating and precipitating titanium. Pyrophosphate ion, however, has the advantage of suppressing aggregation and precipitation of titanium, so that pyrophosphate ion can restrain unfavorable influence due to water quality. However, when the concentration of pyrophosphate is higher than 60 ppm, there is such a tendency that an inactive film is formed on the steel surface (Degree of the formation of inactive film depends on type of steel sheet). Such inactive film on the steel surface inhibits the phosphate coating formation in the following stage. In this respect, the present inventors have studied how to cope with the situation, and as a result it has been found that when magnesium ion is included in such aqueous activating solution in such that a ratio of Mg mol/$P_2O_7$ mol is in 0.4–1.1, formation of the inactive film as mentioned above can be suppressed. As described above, if the pyrophosphate ion and magnesium ion are maintained at their most suitable ranges as mentioned above in the aqueous activating solution, a thin and fine-size crystalline phosphate coating can stably be formed on the steel surface substantially irrespective of the type.

In the above-mentioned molar ratio, slight deviations of the ratio, i.e., one slightly smaller than 0.4 and one slightly larger than 1.1 are permissible, but remarkable deviation is not desirable because it easily brings about either such tendency that the aqueous activating solution deteriorates with time, or problems such as inactivation of the steel surface to be treated.

The total phosphate ion (as $PO_4$) is represented by total amount of $PO_4$, $P_2O_7$ and the like ions calculated as $PO_4$, and the concentration of the total phosphate ion in the aqueous activating solution is preferably maintained at a range of 150–3,000 ppm. When less than 150 ppm, there is a tendency that titanium in the aqueous activating solution aggregates and precipitates easily and it is not preferable. On the other hand, when more than 3,000 ppm, there is not particularly an adverse effect, but the upper limit of 3,000 ppm is preferable from economical point of view.

Finally, pH of aqueous activating solution is preferably within a range of 8.0–9.5. A pH of less than 8.0 is not preferable, because an inactive blue color film is easily formed on the steel surface at such a pH value, and this inactive film has an inhibitory effect upon phosphate coating formation in the subsequent phosphating stage. At a pH of more than 9.5, there are such adverse influences that the activating effect decreases and the life of the aqueous activating solution shortens.

As described above, the process for activating steel surface and the aqueous activating solution utilized therefore according to the present invention have excellent advantages as enumerated hereinbelow in comparison with conventional processes and aqueous activating solutions which have been publicly known.

(1) In the activating treatment, there is no tendency of inactivating the steel surface to be treated so that satisfactory activating effect can be evenly achieved irrespective of type of steel sheets.

(2) In the subsequent phosphating treatment stage, a thin, dense fine-size crystalline phosphate coating can be formed uniformly and stably on the steel surface.

(3) Since the aqueous activating solution of the present invention contains magnesium ion, there is no adverse effect upon a steel surface due to pyrophosphate ion, and life of the aqueous solution is prolonged because the aqueous solution itself hardly deteriorates with time.

As is apparent from the above-mentioned advantages, the process for activating steel surface and the aqueous activating solution according to the present invention attain excellent advantages in phosphating treatment being a pretreatment prior to painting, and particularly excellent advantages can be obtained for uniformly and stably forming a thin, dense, fine-size crystalline phosphate coating on the surface of automobile body composed of various types of steel sheet.

The advantages of the present invention will more specifically be described hereinbelow in connection with examples.

1. Test Panels: The following two types of steel sheets A and B are prepared.
   A: JIS-G-3141,SPCC
   B: Drawing quality bake-hardenable high tension steel
2. Preparation of Each Treating Solution:
   (1) Alkaline Cleaning Solution FINE CLEANER L 4422 (manufactured by Nihon Parkerizing Co., Ltd.) is used.
   pH about 10.2
   total alkalinity 16±point (10 ml sample, Bromophenol Blue indicator, titration with 0.1N $H_2SO_4$)
   (2) Aqueous Activating Solution Aqueous solution of Example 1 is obtained by allowing magnesium ion with molar ratio of 0.5 to pyrophosphate ion to be included in a generally used typical aqueous activating solution containing pyrophosphate ion, Example 2 is obtained by changing the concentration of the same aqueous solution, Example 3 is obtained by permitting magnesium ion with molar ratio of 0.7 to pyrophosphate ion to be included in another aqueous activating solution Example 4 is obtained by changing the concentration of the same aqueous solution of Example 3, and further Example 5 is obtained by allowing magnesium ion with molar ratio of 1.0 to pyrophosphate ion to be included in the other aqueous activating solution, and data and test results relating to these Examples are indicated in the following Table 1 (A), (B), respectively.
   (3) Phosphate Solution (Zinc Phosphate type) BONDERITE L 3080 (manufactured by Nihon Parkerizing Co., Ltd.) is used.
   free acidity 0.8–1.0 point (10 ml sample, Bromophenol Blue indicator, titration with 0.1N NaOH)
   total acidity 22–24 point (10 ml sample, phenolphthalein indicator, titration with 0.1N NaOH)
   concentration of accelerator ($NO_2$) 2.5–3 point (saccharometer method)
3. Treating Process:
   (1) alkaline cleaning 43°±1° C., immersion for 4 min.
   (2) water rinsing
   (3) activating treatment room temperature, immersion for 90 sec.
   (4) phosphating treatment 43°±1° C., immersion for 120 sec.
   (5) water rinsing
   (6) deionized water rinsing
   (7) drying-off about 80° C.
4. Analytical Method for Each Component Contained in aqueous Activating Solution:
   (1) Ti $H_2O_2$ colorimetry
   (2) Total phosphate ion as $PO_4$ After hydrolyzing the $P_2O_7$ to $PO_4$ amount of the total phosphate ion, $PO_4$ is determined by the ammonium molybdate precipitation method.
   (3) $P_2O_7$ After determining $PO_4$ with the ammonium molybdate method, the amount of $PO_4$ is subtracted from the total phosphate ion to obtain a difference, and amount of $P_2O_7$ is determined on the basis of the difference.
   (4) Mg EDTA titration or atomic-absorption spectroscopy
5. Evaluation of Phosphate Coating:
   (1) Appearance:
   o: Dense, uniform coating of fine-size crystals
   Δ: Partially ununiform and formation of blue color coating in the ununiform portions
   x: Occurrence of yellow rust
   (2) Coating Weight: Coating film is stripped with 5% aqueous chromic acid solution
   (3) Crystal Size: Crystal size is measured by means of scan electron microscope in μ unit.
6. Comparative Examples: In order to compare with the above Examples, some aqueous activating solutions which have generally been employed were tested. Among them, one containing no pyrophosphate ion is selected as Comparative Example 1, and two kinds of them which contain any amount of pyrophosphate ion, but different amounts of the ion from each other are selected as Comparative Examples 2 and 3, respectively, and data and test results relating to all the Comparative Examples are also indicated in Table 1 (A), (B).

TABLE 1

| | | | Example | | | | | Comparative Example | | |
|---|---|---|---|---|---|---|---|---|---|---|
| | | | 1 | 2 | 3 | 4 | 5 | 1 | 2 | 3 |
| Activating Composition | | | | | | | | | | |
| Raw Materials used for manufacturing activating compositions | | Titanyl Sulfate (Ti 19%) | 62.2 parts | 62.2 parts | 36.0 parts | Same as Ex. 3 | 53.3 parts | 53.3 parts | 62.2 parts | 53.3 parts |
| | | Titanyl Sulfate (Ti 10%) | — | — | 68.4 | | — | — | — | — |
| | | $Na_2HPO_4$ | 583.2 | 583.2 | 675.1 | | 498.2 | 498.2 | 583.2 | 498.2 |
| | | $H_2O$ | 1330.0 | 1330.0 | 1350.0 | | 996.0 | 996.0 | 1330.0 | 996.0 |
| | | $Na_4P_2O_7$ | 289.1 | 289.1 | 167.5 | | 308.7 | — | 209.1 | 308.7 |
| | | $MgSO_4$ | 65.5 | 65.5 | 53.0 | | 139.8 | — | — | — |
| Property | | Moisture Wt % | 1.8 | 1.8 | 1.9 | Same as Ex. 3 | 1.3 | 1.5 | 1.8 | 1.5 |
| | | Ti Wt % | 1.16 | 1.16 | 1.34 | Same as Ex. 3 | 1.0 | 1.74 | 1.24 | 1.15 |
| Concentration of the activating composition g/l($H_2O$) | | | 0.44 | 0.9 | 0.8 | 3.1 | 1.0 | 0.8 | 0.4 | 0.9 |
| Activating | | | | | | | | | | |
| Ti ppm | | | 5 | 10 | 10 | 40 | 10 | 14 | 5 | 10 |
| $P_2O_7$ ppm | | | 80 | 166 | 81 | 320 | 200 | — | 79 | 207 |
| Total phosphate, as $PO_4$ ppm | | | 252 | 515 | 417 | 1668 | 548 | 466 | 243 | 550 |
| Mg ppm | | | 5.6 | 11.5 | 8 | 31 | 28 | — | — | — |
| Mg mol/$P_2O_7$ mol | | | 0.5 | 0.5 | 0.7 | 0.7 | 1.0 | — | — | — |
| pH | | | 8.5 | 8.6 | 8.7 | 8.8 | 8.8 | 8.1 | 8.7 | 8.8 |
| Phosphating Treatment | | | | | | | | | | |
| In the use of freshly prepared activating solution | On Test Panel A | Appearance | o | o | o | o | o | o | o | Δ* |
| | | Coating Wt. g/m² | 2.4 | 2.4 | 2.3 | 2.3 | 2.3 | 2.7 | 2.3 | 1.6 |
| | | Crystal Size μ | 2~4 | 2~3 | 2~3 | 2~3 | 2 | 2~7 | 2~3 | 1~2 |
| | On Test Panel B | Appearance | o | o | o | o | o | o | Δ* | Δ~X* |
| | | Coating Wt. g/m² | 2.4 | 2.4 | 2.3 | 2.3 | 2.3 | 2.7 | 1.7 | 1.3 |
| | | Crystal Size μ | 2~4 | 2~3 | 2~3 | 2~3 | 2 | 5~10 | 1~2 | 1~2 |
| In the use of activating solution allow to stand for 10 days after building | On Test Panel A | Appearance | o | o | o | o | o | X | o | Δ* |
| | | Coating Wt. g/m² | 2.6 | 2.5 | 2.4 | 2.3 | 2.3 | — | 2.3 | 1.6 |
| | | Crystal Size μ | 2~5 | 2~3 | 2~3 | 2~3 | 2~3 | — | 2~4 | 1~2 |
| | On Test Panel B | Appearance | o | o | o | o | o | X | Δ* | Δ~X* |
| | | Coating Wt. g/m² | 2.6 | 2.4 | 2.3 | 2.4 | 2.3 | — | 1.8 | 1.3 |
| | | Crystal Size μ | 2~5 | 2~3 | 2~3 | 2~3 | 2~3 | — | 1~2 | 1~2 |

(Note)
*means that an inactive film was formed on the steel surface during the activating process so that non-uniform phosphate coating was formed in the subsequent phosphating stage. Thus there were portions on which no crystalline phosphate coating was formed, and as a result such panels,indicated a low coating weight.

What is claimed is:

1. A process for activating steel surface prior to phosphating treatment wherein the steel surface is cleaned, the cleaned steel surface is then treated with an aqueous activating solution comprising 3–100 ppm of titanium, 60–360 ppm of pyrophosphate ion, 150–3000 ppm of the total phosphate ion as $PO_4$, and 0.4–1.1 molar ratio magnesium ion to said pyrophosphate ion, and with a pH of 8.0–9.5, and thereafter the steel surface is treated with a phosphating solution, wherein said magnesium ion is included in said aqueous activating solution in order to suppress formation of an inactive film on said steel surface due to the presence of said pyrophosphate ion.

2. A process for activating steel surface as claimed in claim 1, characterized in that the treatment is conducted by immersing said steel surface in said aqueous activating solution at a temperature of about 15° C. to about 40° C., for a period of about 10 to about 400 seconds.

3. An aqueous activating solution containing titanium and pyrophosphate ion which is used for activating a steel surface after cleaning said steel surface and before the treatment of said steel surface with a phosphating solution, characterized in that said aqueous activating solution comprises 3–100 ppm of titanium, 60–360 ppm of pyrophosphate ion, 150–3,000 ppm of the total phosphate ion as $PO_4$, and 0.4–1.1 molar ratio of magnesium ion to said pyrophosphate ion, and with a pH of 8.0–9.5.

4. An aqueous activating solution as claimed in claim 3, characterized in that the titanium component is selected from the group consisting of titanyl sulfate, titanium tetrachloride, titanium trichloride, titanium hydroxide, titanium oxide.

5. An aqueous activating solution as claimed in claim 3, characterized in that the pyrophosphate component is selected from the group consisting of sodium pyrophosphonate and magnesium ammonium pyrophosphate.

6. An aqueous activating solution as claimed in claim 3, characterized in containing a phosphate selected from the group consisting of disodium phosphate, diammonium phosphate, trisodium phosphate, and triammonium phosphate.

7. An aqueous activating solution as claimed in claim 3, characterized in that the magnesium component is selected from the group consisting of magnesium ammonium pyrophosphate, magnesium sulfate, and basic magnesium carbonate.

8. An aqueous activating solution as claimed in claim 3, characterized in containing titanyl sulfate, $Na_2HPO_4$, $Na_4P_2O_7$ and $MgSO_4$.

9. An aqueous activating solution as claimed in claim 8, characterized in containing 5–40 ppm titanium, 80–320 ppm pyrophosphate ion, 252–1668 ppm total phosphate, 0.5–1.0 molar ratio and a pH of 8.5–8.8.

10. An aqueous activating solution as claimed in claim 3, characterized in containing 5–40 ppm titanium, 80–320 ppm pyrophosphate ion, 252–1668 ppm total phosphate, 0.5–1.0 molar ratio and a pH of 8.5–8.8.

11. A process for activating steel surface as claimed in claim 2, characterized in that the temperature is 23°–30° C. and the time is 20–100 seconds.

* * * * *

UNITED STATES PATENT AND TRADEMARK OFFICE

CERTIFICATE OF CORRECTION

PATENT NO. : 4,517,030

DATED : May 14, 1985

INVENTOR(S) : T. Yamamoto et al

It is certified that error appears in the above-identified patent and that said Letters Patent are hereby corrected as shown below:

In the headings, read

--Foreign Application Priority Data.

August 10, 1983[JA] Japan.... 145867/83

Signed and Sealed this

*Fifteenth* Day of *October 1985*

[SEAL]

*Attest:*

*Attesting Officer*

DONALD J. QUIGG

*Commissioner of Patents and Trademarks—Designate*